US010022993B2

(12) United States Patent
Ho et al.

(10) Patent No.: US 10,022,993 B2
(45) Date of Patent: Jul. 17, 2018

(54) MEDIA GUIDES FOR USE IN PRINTERS AND METHODS FOR USING THE SAME

(71) Applicant: Datamax-O'Neil Corporation, Orlando, FL (US)

(72) Inventors: Wai Kit Ho, Singapore (SG); Chia Kiang Sum, Singapore (SG)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

(21) Appl. No.: 15/367,359

(22) Filed: Dec. 2, 2016

(65) Prior Publication Data

US 2018/0154662 A1 Jun. 7, 2018

(51) Int. Cl.

| | |
|---|---|
| ***B41J 15/04*** | (2006.01) |
| ***B41J 2/325*** | (2006.01) |
| ***B41J 15/02*** | (2006.01) |

(52) U.S. Cl.

CPC ..... *B41J 15/046* (2013.01); *B41J 2/325* (2013.01); *B41J 15/02* (2013.01)

(58) Field of Classification Search

CPC ..... B41J 15/046; B41J 2/325; B41J 15/02
See application file for complete search history.

(56) References Cited

U.S. PATENT DOCUMENTS 4,027,590 A * 6/1977 Seidl ..... B65C 11/0289 101/228
6,130,699 A * 10/2000 Christensen ..... B41J 15/02 347/218
6,164,203 A * 12/2000 Keller ..... B41J 15/02 101/288
6,336,757 B1 1/2002 Nishimura et al.
6,726,145 B1 4/2004 Kraus
(Continued)

FOREIGN PATENT DOCUMENTS

JP 2012218343 A 11/2012
WO 2013163789 A1 11/2013
(Continued)

OTHER PUBLICATIONS

U.S. Appl. No. 14/715,916 for Evaluating Image Values, filed May 19, 2015 (Ackley); 60 pages.
(Continued)

*Primary Examiner* — Yaovi M Ameh
(74) *Attorney, Agent, or Firm* — Additon, Higgins & Pendleton, P.A.

(57) ABSTRACT

A media guide is provided for use in printer. Media guide includes main body portion having internal bore configured to be disposed around media spindle and guide member connected to main body portion. Guide member is configured to extend outwardly from main body portion to extended position and to retract toward main body portion to collapsed position. Method for using media guide is also provided. Media guide is disposed on media spindle such that media spindle extends through internal bore of main body portion and is positioned and locked at selected position along length of media spindle. When media roll is disposed on media spindle, guide member is extended to extended position. When media roll is configured to be one of loaded onto or unloaded from media spindle, guide member is retracted to collapsed position.

22 Claims, 3 Drawing Sheets

(56) References Cited

U.S. PATENT DOCUMENTS 6,832,725 B2 12/2004 Gardiner et al.
7,128,266 B2 10/2006 Marlton et al.
7,140,794 B2 11/2006 Redman et al.
7,159,783 B2 1/2007 Walczyk et al.
7,413,127 B2 8/2008 Ehrhart et al.
7,726,575 B2 6/2010 Wang et al.
8,294,969 B2 10/2012 Plesko
8,317,105 B2 11/2012 Kotlarsky et al.
8,322,622 B2 12/2012 Suzhou et al.
8,366,005 B2 2/2013 Kotlarsky et al.
8,371,507 B2 2/2013 Haggerty et al.
8,376,233 B2 2/2013 Van Horn et al.
8,381,979 B2 2/2013 Franz
8,390,909 B2 3/2013 Plesko
8,408,464 B2 4/2013 Zhu et al.
8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz, Sr.
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,736,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Bremer et al.
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.

(56) References Cited

U.S. PATENT DOCUMENTS 8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.
8,967,468 B2 3/2015 Gomez et al.
8,971,346 B2 3/2015 Sevier
8,976,030 B2 3/2015 Cunningham
8,976,368 B2 3/2015 Akel et al.
8,978,981 B2 3/2015 Guan
8,978,983 B2 3/2015 Bremer et al.
8,978,984 B2 3/2015 Hennick et al.
8,985,456 B2 3/2015 Zhu et al.
8,985,457 B2 3/2015 Soule et al.
8,985,459 B2 3/2015 Kearney et al.
8,985,461 B2 3/2015 Gelay et al.
8,988,578 B2 3/2015 Showering
8,988,590 B2 3/2015 Gillet et al.
8,991,704 B2 3/2015 Hopper et al.
8,996,194 B2 3/2015 Davis et al.
8,996,384 B2 3/2015 Funyak et al.
8,998,091 B2 4/2015 Edmonds et al.
9,002,641 B2 4/2015 Showering
9,007,368 B2 4/2015 Laffargue et al.
9,010,641 B2 4/2015 Qu et al.
9,015,513 B2 4/2015 Murawski et al.
9,016,576 B2 4/2015 Brady et al.
D730,357 S 5/2015 Fitch et al.
9,022,288 B2 5/2015 Nahill et al.
9,030,964 B2 5/2015 Essinger et al.
9,033,240 B2 5/2015 Smith et al.
9,033,242 B2 5/2015 Gillet et al.
9,036,054 B2 5/2015 Koziol et al.
9,037,344 B2 5/2015 Chamberlin
9,038,911 B2 5/2015 Xian et al.
9,038,915 B2 5/2015 Smith
D730,901 S 6/2015 Oberpriller et al.
D730,902 S 6/2015 Fitch et al.
D733,112 S 6/2015 Chaney et al.
9,047,098 B2 6/2015 Barten
9,047,359 B2 6/2015 Caballero et al.
9,047,420 B2 6/2015 Caballero
9,047,525 B2 6/2015 Barber
9,047,531 B2 6/2015 Showering et al.
9,049,640 B2 6/2015 Wang et al.
9,053,055 B2 6/2015 Caballero
9,053,378 B1 6/2015 Hou et al.
9,053,380 B2 6/2015 Xian et al.
9,057,641 B2 6/2015 Amundsen et al.
9,058,526 B2 6/2015 Powilleit
9,064,165 B2 6/2015 Havens et al.
9,064,167 B2 6/2015 Xian et al.
9,064,168 B2 6/2015 Todeschini et al.
9,064,254 B2 6/2015 Todeschini et al.
9,066,032 B2 6/2015 Wang
9,070,032 B2 6/2015 Corcoran
D734,339 S 7/2015 Zhou et al.
D734,751 S 7/2015 Oberpriller et al.
9,082,023 B2 7/2015 Feng et al.
9,224,022 B2 12/2015 Ackley et al.
9,224,027 B2 12/2015 Van Horn et al.
D747,321 S 1/2016 London et al.
9,230,140 B1 1/2016 Ackley
9,443,123 B2 1/2016 Hejl
9,250,712 B1 2/2016 Todeschini
9,258,033 B2 2/2016 Showering
9,262,633 B1 2/2016 Todeschini et al.
9,310,609 B2 4/2016 Rueblinger et al.
D757,009 S 5/2016 Oberpriller et al.
9,342,724 B2 5/2016 McCloskey
9,375,945 B1 6/2016 Bowles
D760,719 S 7/2016 Zhou et al.
9,390,596 B1 7/2016 Todeschini
D762,604 S 8/2016 Fitch et al.
D762,647 S 8/2016 Fitch et al.
9,412,242 B2 8/2016 Van Horn et al.
D766,244 S 9/2016 Zhou et al.
9,443,222 B2 9/2016 Singel et al.
9,478,113 B2 10/2016 Xie et al.
2007/0063048 A1 3/2007 Havens et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0074905 A1* 3/2011 Marcus ..... B41J 17/02 347/218
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0287258 A1 10/2013 Kearney
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Corcoran
2013/0313324 A1 11/2013 Koziol et al.
2013/0313325 A1 11/2013 Wilz et al.
2013/0342717 A1 12/2013 Havens et al.
2014/0001267 A1 1/2014 Giordano et al.
2014/0002828 A1 1/2014 Laffargue et al.
2014/0008439 A1 1/2014 Wang
2014/0025584 A1 1/2014 Liu et al.
2014/0034734 A1 2/2014 Sauerwein
2014/0036848 A1 2/2014 Pease et al.
2014/0039693 A1 2/2014 Havens et al.
2014/0042814 A1 2/2014 Kather et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078341 A1 3/2014 Havens et al.
2014/0078342 A1 3/2014 Li et al.
2014/0078345 A1 3/2014 Showering
2014/0098792 A1 4/2014 Wang et al.
2014/0100774 A1 4/2014 Showering
2014/0100813 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Li et al.
2014/0104451 A1 4/2014 Todeschini et al.
2014/0106594 A1 4/2014 Skvoretz
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0121438 A1 5/2014 Kearney
2014/0121445 A1 5/2014 Ding et al.
2014/0124577 A1 5/2014 Wang et al.
2014/0124579 A1 5/2014 Ding

(56) References Cited

U.S. PATENT DOCUMENTS

2014/0125842 A1 5/2014 Winegar
2014/0125853 A1 5/2014 Wang
2014/0125999 A1 5/2014 Longacre et al.
2014/0129378 A1 5/2014 Richardson
2014/0131441 A1 5/2014 Nahill et al.
2014/0131443 A1 5/2014 Smith
2014/0131444 A1 5/2014 Wang
2014/0131448 A1 5/2014 Xian et al.
2014/0133379 A1 5/2014 Wang et al.
2014/0136208 A1 5/2014 Maltseff et al.
2014/0140585 A1 5/2014 Wang
2014/0151453 A1 6/2014 Meier et al.
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0166759 A1 6/2014 Liu et al.
2014/0168787 A1 6/2014 Wang et al.
2014/0175165 A1 6/2014 Havens et al.
2014/0175172 A1 6/2014 Jovanovski et al.
2014/0191644 A1 7/2014 Chaney
2014/0191913 A1 7/2014 Ge et al.
2014/0197238 A1 7/2014 Lui et al.
2014/0197239 A1 7/2014 Havens et al.
2014/0197304 A1 7/2014 Feng et al.
2014/0203087 A1 7/2014 Smith et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0232930 A1 8/2014 Anderson
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0284384 A1 9/2014 Lu et al.
2014/0288933 A1 9/2014 Braho et al.
2014/0297058 A1 10/2014 Barker et al.
2014/0299665 A1 10/2014 Barber et al.
2014/0312121 A1 10/2014 Lu et al.
2014/0319220 A1 10/2014 Coyle
2014/0319221 A1 10/2014 Oberpriller et al.
2014/0326787 A1 11/2014 Barten
2014/0332590 A1 11/2014 Wang et al.
2014/0344943 A1 11/2014 Todeschini et al.
2014/0346233 A1 11/2014 Liu et al.
2014/0351317 A1 11/2014 Smith et al.
2014/0353373 A1 12/2014 Van Horn et al.
2014/0361073 A1 12/2014 Qu et al.
2014/0361082 A1 12/2014 Xian et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0001304 A1 1/2015 Todeschini
2015/0003673 A1 1/2015 Fletcher
2015/0009338 A1 1/2015 Laffargue et al.
2015/0009610 A1 1/2015 London et al.
2015/0014416 A1 1/2015 Kotlarsky et al.
2015/0021397 A1 1/2015 Rueblinger et al.
2015/0028102 A1 1/2015 Ren et al.
2015/0028103 A1 1/2015 Jiang
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0048168 A1 2/2015 Fritz et al.
2015/0049347 A1 2/2015 Laffargue et al.
2015/0051992 A1 2/2015 Smith
2015/0053766 A1 2/2015 Havens et al.
2015/0053768 A1 2/2015 Wang et al.
2015/0053769 A1 2/2015 Thuries et al.
2015/0062366 A1 3/2015 Liu et al.
2015/0063215 A1 3/2015 Wang
2015/0063676 A1 3/2015 Lloyd et al.
2015/0069130 A1 3/2015 Gannon
2015/0071818 A1 3/2015 Todeschini
2015/0083800 A1 3/2015 Li et al.
2015/0086114 A1 3/2015 Todeschini
2015/0088522 A1 3/2015 Hendrickson et al.
2015/0096872 A1 4/2015 Woodburn
2015/0099557 A1 4/2015 Pettinelli et al.
2015/0100196 A1 4/2015 Hollifield
2015/0102109 A1 4/2015 Huck
2015/0115035 A1 4/2015 Meier et al.
2015/0127791 A1 5/2015 Kosecki et al.
2015/0128116 A1 5/2015 Chen et al.
2015/0129659 A1 5/2015 Feng et al.
2015/0133047 A1 5/2015 Smith et al.
2015/0134470 A1 5/2015 Hejl et al.
2015/0136851 A1 5/2015 Harding et al.
2015/0136854 A1 5/2015 Lu et al.
2015/0142492 A1 5/2015 Kumar
2015/0144692 A1 5/2015 Hejl
2015/0144698 A1 5/2015 Teng et al.
2015/0144701 A1 5/2015 Xian et al.
2015/0149946 A1 5/2015 Benos et al.
2015/0161429 A1 6/2015 Xian
2015/0169925 A1 6/2015 Chang et al.
2015/0169929 A1 6/2015 Williams et al.
2015/0186703 A1 7/2015 Chen et al.
2015/0193644 A1 7/2015 Kearney et al.
2015/0193645 A1 7/2015 Colavito et al.
2015/0199957 A1 7/2015 Funyak et al.
2015/0204671 A1 7/2015 Showering
2015/0210199 A1 7/2015 Payne
2015/0220753 A1 8/2015 Zhu et al.
2015/0254485 A1 9/2015 Feng et al.
2015/0327012 A1 11/2015 Bian et al.
2016/0014251 A1 1/2016 Hejl
2016/0040982 A1 2/2016 Li et al.
2016/0042241 A1 2/2016 Todeschini
2016/0057230 A1 2/2016 Todeschini et al.
2016/0109219 A1 4/2016 Ackley et al.
2016/0109220 A1 4/2016 Laffargue
2016/0109224 A1 4/2016 Thuries et al.
2016/0112631 A1 4/2016 Ackley et al.
2016/0112643 A1 4/2016 Laffargue et al.
2016/0124516 A1 5/2016 Schoon et al.
2016/0125217 A1 5/2016 Todeschini
2016/0125342 A1 5/2016 Miller et al.
2016/0133253 A1 5/2016 Braho et al.
2016/0171720 A1 6/2016 Todeschini
2016/0178479 A1 6/2016 Goldsmith
2016/0180678 A1 6/2016 Ackley et al.
2016/0189087 A1 6/2016 Morton et al.
2016/0125873 A1 7/2016 Braho et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.
2016/0306769 A1 10/2016 Kohtz et al.
2016/0314276 A1 10/2016 Sewell et al.
2016/0314294 A1 10/2016 Kubler et al.

FOREIGN PATENT DOCUMENTS

WO 2013173985 A1 11/2013
WO 2014019130 A1 2/2014
WO 2014110495 A1 7/2014

OTHER PUBLICATIONS

U.S. Appl. No. 29/525,068 for Tablet Computer With Removable Scanning Device, filed Apr. 27, 2015 (Schulte et al.); 19 pages.

(56) References Cited

OTHER PUBLICATIONS

U.S. Appl. No. 29/468,118 for an Electronic Device Case, filed Sep. 26, 2013 (Oberpriller et al.); 44 pages.
U.S. Appl. No. 29/530,600 for Cyclone, filed Jun. 18, 2015 (Vargo et al); 16 pages.
U.S. Appl. No. 14/707,123 for Application Independent DEX/UCS Interface, filed May 8, 2015 (Pape); 47 pages.
U.S. Appl. No. 14/283,282 for Terminal Having Illumination and Focus Control, filed May 21, 2014 (Liu et al.); 31 pages; now abandoned.
U.S. Appl. No. 14/705,407 for Method and System to Protect Software-Based Network-Connected Devices From Advanced Persistant Threat, filed May 6, 2015 (Hussey et al.); 42 pages.
U.S. Appl. No. 14/704,050 for Intermediate Linear Positioning filed, May 5, 2015 (Charpentier et al.); 60 pages.
U.S. Appl. No. 14/705,012 for Hands-Free Human Machine Interface Responsive to a Driver of a Vehicle, filed May 6, 2015 (Fitch et al.); 44 pages.
U.S. Appl. No. 14/715,672 for Augemented Reality Enabled Hazard Display, filed May 19, 2015 (Venkatesha et al.); 35 pages.
U.S. Appl. No. 14/735,717 for Indicia-Reading Systems Having an Interface With a User's Nervous System, filed Jun. 10, 2015 (Todeschini); 39 pages.
U.S. Appl. No. 14/702,110 for System and Method for Regulating Barcode Data Injection Into a Running Application on a Smart Device, filed May 1, 2015 (Todeschini et al.); 38 pages.
U.S. Appl. No. 14/747,197 for Optical Pattern Projector, filed Jun. 23, 2015 (Thuries et al.); 33 pages.
U.S. Appl. No. 14/702,979 for Tracking Battery Conditions, filed May 4, 2015 (Young et al.); 70 pages.
U.S. Appl. No. 29/529,441 for Indicia Reading Device, filed Jun. 8, 2015 (Zhou et al.); 14 pages.
U.S. Appl. No. 14/747,490 for Dual-Projector Three-Dimensional Scanner, filed Jun. 23, 2015 (Jovanovski et al.); 40 pages.
U.S. Appl. No. 14/740,320 for Tactile Switch for a Mobile Electronic Device, filed Jun. 16, 2015 (Bamdringa); 38 pages.
U.S. Appl. No. 14/740,373 for Calibrating a Volume Dimensioner, filed Jun. 16, 2015 (Ackley et al.); 63 pages.
U.S. Appl. No. 13/367,978, filed Feb. 7, 2012, (Feng et al.); now abandoned.
U.S. Appl. No. 14/277,337 for Multipurpose Optical Reader, filed May 14, 2014 (Jovanovski et al.); 59 pages; now abandoned.
U.S. Appl. No. 14/446,391 for Multifunction Point of Sale Apparatus With Optical Signature Capture, filed Jul. 30, 2014 (Good et al.); 37 pages; now abandoned.
U.S. Appl. No. 29/516,892 for Table Computer, filed Feb. 6, 2015 (Bidwell et al.); 13 pages.
U.S. Appl. No. 29/523,098 for Handle for a Tablet Computer, filed Apr. 7, 2015 (Bidwell et al.); 17 pages.
U.S. Appl. No. 29/528,890 for Mobile Computer Housing, filed Jun. 2, 2015 (Fitch et al.); 61 pages.
U.S. Appl. No. 29/526,918 for Charging Base, filed May 14, 2015 (Fitch et al.); 10 pages.

* cited by examiner

MEDIA GUIDES FOR USE IN PRINTERS AND METHODS FOR USING THE SAME

FIELD OF THE INVENTION

The present invention relates to printers and more particularly relates to media guides for use in printers, and methods for using the same.

BACKGROUND

Conventional barcode printers are normally equipped with a media guide to help control the position of print media supplied from a media supply roll and rewound onto a media rewind roll in an effort to obtain good printing performance during printer operation. The media supply roll comprises print media wound onto a media core. The media rewind roll may be a depleted media supply roll, or an empty media take (i.e., an empty media core).

However, conventional media guides may be too big, obstructing loading and unloading of the media supply roll onto and from a media supply spindle of the printer and/or obstructing loading and unloading of the media rewind roll onto and from a media rewind spindle of the printer. Conventional media guides may alternatively be too small to sufficiently guide (i.e., control the position of) the full media supply roll and/or the full media rewind roll all the way through to depletion. Media guides that are too small may also damage the print media due to physical edge contact as the print media unwinds from the media supply roll.

Therefore, a need exists for media guides for use in printers, and methods for using the same. There is also a need for media guides that permit unobstructed loading and unloading of the media supply roll and/or media rewind roll, achieve good guiding performance, and may be used in printers having limited space.

SUMMARY

A media guide is provided for use in a printer having a media spindle, according to various embodiments of the present invention. The media guide comprises a main body portion having an internal bore configured to be disposed around the media spindle and a guide member connected to the main body portion. The guide member is configured to extend outwardly from the main body portion to an extended position and to retract toward the main body portion to a collapsed position.

A printer is provided, according to various embodiments of the present invention. The printer comprises a media spindle configured for having a media roll disposed thereon and a media guide. The media guide comprises a main body portion having an internal bore and a guide member connected to the main body portion. The internal bore is configured to be disposed around the media spindle at a position outboard of the media roll. The guide member is configured to be extended outwardly from the main body portion to an extended position and to be retracted toward the main body portion to a collapsed position.

A method is provided for using a media guide in a printer, according to various embodiments of the present invention. The method comprises disposing the media guide on a media spindle and positioning and locking the media guide at a selected position along a length of the media spindle. When the media roll is disposed on the media spindle, the method further comprises extending the guide member to an extended position. When the media roll is configured to be one of loaded onto or unloaded from the media spindle, the method further comprises collapsing the guide member to a collapsed position. The media guide is disposed on the media spindle such that the media spindle extends through an internal bore of a main body portion of the media guide. The main body portion is connected to a guide member of the media guide.

The foregoing illustrative summary, as well as other exemplary objectives and/or advantages of the present invention, and the manner in which the same are accomplished, are further explained within the following detailed description and its accompanying drawings.

DETAILED DESCRIPTION

Various embodiments are directed to media guides for use in printers, and methods for using the same. Various embodiments provide a media guide that permits unobstructed loading and unloading of a media roll, achieves good guiding performance in guiding the media roll, and may be used in printers having limited space. As used herein, a "media roll" comprises a media supply roll and/or a media rewind roll and a "media spindle" comprises a media supply spindle and/or a media rewind spindle.

Various embodiments of the present invention will be described in relation to a thermal transfer barcode printer. As used herein, the term "printer" refers to a device that prints text, barcodes, illustrations, etc. onto the print media (e.g., labels, tickets, plain paper, receipt paper, plastic transparencies, and the like. In the thermal transfer printer, an ink ribbon supplies the media (e.g., ink) that transfers onto the print media. However, the present invention may be equally applicable to other types and styles of printers that may benefit from using a media guide therein (e.g., a direct transfer barcode printer).

Figure 1A:
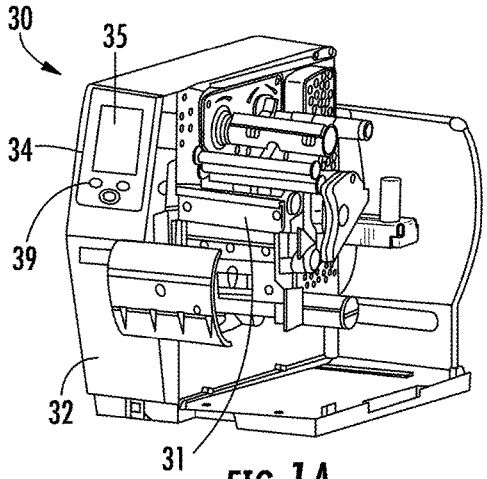
FIG. 1A graphically illustrates a portion of an exemplary printer in which a media guide may be used according to various embodiments, a cover of the printer removed to illustrate a ribbon supply spindle, a media supply spindle, and a media rewind spindle of the printer.
Figure 1B:
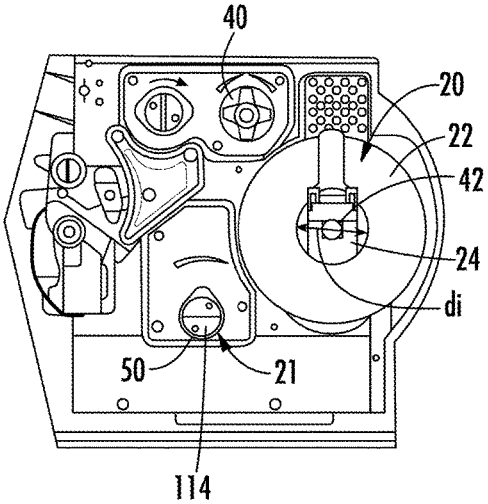
FIG. 1B schematically depicts components of the printer of FIG. 1A according to various embodiments, illustrating a media supply roll (an exemplary media roll) disposed on the media supply spindle (an exemplary media spindle) and a media rewind roll (an exemplary media roll) disposed on the media rewind spindle (an exemplary media spindle) with a media guide according to various embodiments disposed on the media rewind spindle.
Figure 1C:
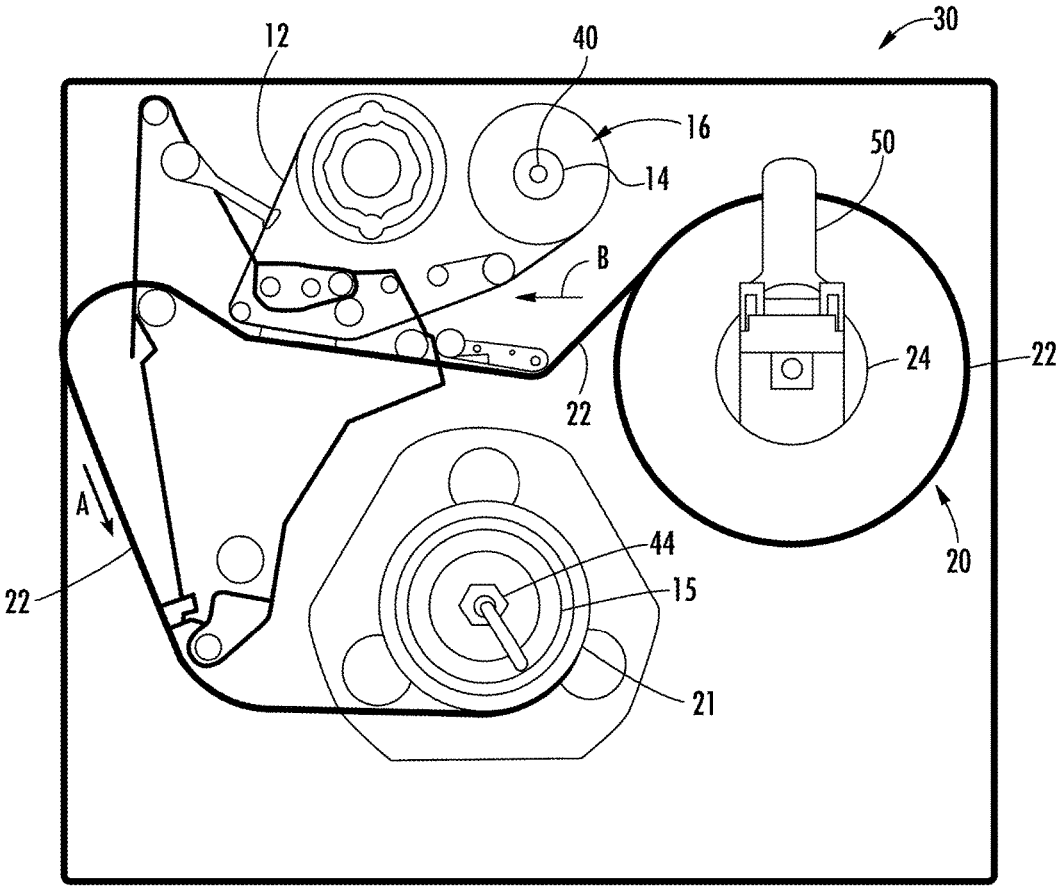
FIG. 1C schematically depicts a print media path as print media from the media supply roll disposed on the media supply spindle unwinds therefrom, travels through the printer, and is rewound onto the media rewind roll disposed on the media rewind spindle, the media guide according to various embodiments illustrated as disposed on the media supply spindle.

Now referring to FIGS. 1A through 1C, according to various embodiments, an exemplary printer 30 capable of printing on print media 22 and in which a media guide 50 (FIGS. 1B, 1C, and FIGS. 2 through 5) (herein described) may be used is partially shown. The depicted printer 30 has a body including a user interface 34 (FIG. 1) for communication between a user and the printer 30.

In the case of a thermal transfer printer, there may be a ribbon supply spindle 40 contained within the body 32. A ribbon supply roll 16 is configured to be disposed on the ribbon supply spindle 40. The ribbon supply roll 16 comprises ink ribbon 12 wound on a ribbon core 14. As noted previously, in a thermal transfer printer, the ink ribbon supplies the media (e.g., ink) that transfers onto the print media.

The printer 30 may further comprise a thermal print head 31 utilized to thermally transfer a portion of ink from the ink ribbon 12 to the print media 22 as the ink ribbon is unwound from the ribbon supply spool 14 along a ribbon path and the print media 22 is unwound from a media supply spool 24 (also referred to herein as a "media core") along a media path (arrow A in FIG. 1C) as herein described.

A media supply spindle 42 on which the media supply roll 20 is configured to be disposed is contained within the body 32. A media rewind spindle 44 on which unwound print media 22 is wound up may also be contained within the body 32. A media take 15 may be disposed on the media rewind spindle 44 although the media take 15 on the media rewind spindle 44 may not be necessary. The ribbon take on which the unwound print media is wound up is referred to herein as a "media rewind roll" 21. As previously noted, a "media roll" comprises a media supply roll 20 and/or a media rewind roll 21. While a printer having both a media supply spindle and a media rewind spindle is illustrated, it is to be understood that the printer may have only the media supply spindle. Each of the ribbon supply spindle (if present) and the media rewind spindle is configured to rotate during operation of the printer.

The printer 30 further comprises a power source and a moveable cover (removed in FIG. 1 for purposes of illustration) for accessing the media supply spindle 42, the media rewind spindle 44, etc. contained within the body 32. The printer may further comprise a central processing unit (CPU) (not shown). As known in the art, the central processing unit (CPU) is the electronic circuitry within a computer that carries out the instructions of a computer program by performing the basic arithmetic, logical, control and input/output (I/O) operations specified by the instructions as hereinafter described.

The media supply roll 20 comprises print media 22 wound on the media supply spool 24, the print media 22 and media supply spool 24 collectively referred to as the "media supply roll" 20. The print media 22 may be continuous or non-continuous. The media supply roll 20 has an outer diameter (d) (FIG. 1C) and an inner diameter (di) (FIG. 1B). The outer diameter (d) of the media supply roll decreases as the print media 22 is used for printing. The media supply roll inner diameter (di) is also known as a "media core outer diameter" (i.e., the outer diameter of the media supply spool 24 or media core as depicted in FIG. 1B). As noted previously, the print media 22 may comprise labels, tickets, plain paper, plastic transparencies, and the like.

The media supply roll 20 is disposed onto the media supply spindle 42 and the print media 22 threaded through the printer 30 according to the printer manufacturer's instructions. For example, as depicted in FIG. 1C, a print media leading edge is pulled forward (arrow B) from the media supply roll 20 disposed on the media supply spindle 42, threaded through the printer 30, and attached to the media rewind spindle 44 (with, for example, tape on an empty media take 15). The media rewind spindle 44 is rotated until the print media 22 overlaps the print media leading edge and stretches tight.

The printer 30 may further comprise one or more motors (not shown) for rotating the ribbon supply spindle 40 and the ribbon roll 16 disposed thereon (if present) in a forward or a backward rotational direction (dependent on the ink surface), for rotating the media supply roll 20 disposed on the (fixed) media supply spindle 42 in a forward rotational direction, and for rotating the ribbon rewind spindle 44. The printer 30 may have other components as known in the art.

The user interface 34 (FIG. 1A) may include, but is not limited to, a display 35 for displaying information and function buttons 39 that may be configured to perform various typical printing functions (e.g., cancel print job, advance print media, and the like) or be programmable for the execution of macros containing preset printing parameters for a particular type of print media. The display 35 may include a touch screen keypad for entering data or the keypad may be separate. Additionally, the user interface 34 may be operationally/communicatively coupled to the processor (CPU) (not shown) for controlling the operation of the printer 30, in addition to other functions. The user interface 34 may be supplemented by or replaced by other forms of data entry or printer control such as a separate data entry and control module linked wirelessly or by a data cable operationally coupled to a computer, a router, or the like.

Figure 2A:
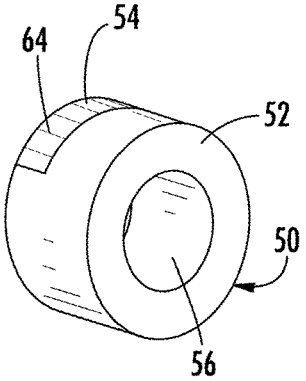
FIGS. 2A and 2B are respectively a perspective view and a front view of the media guide of FIGS. 1B and 1C in isolation, according to various embodiments.
Figure 2B:
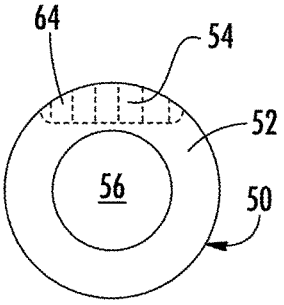
Figure 2C:
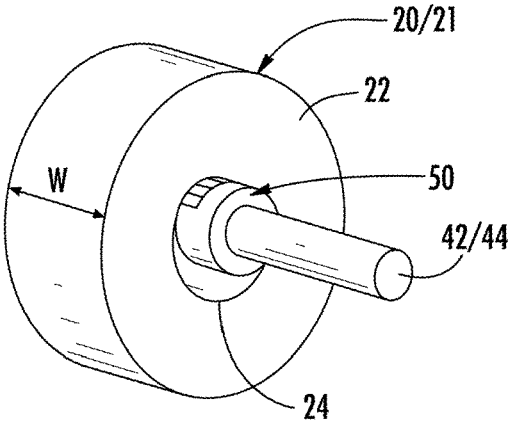
FIG. 2C is an enlarged isolation view of the media roll (such as the media rewind roll and/or media supply roll of FIGS. 1B and 1C) and the media guide of FIGS. 2A and 2B disposed on the media spindle (such as the media rewind spindle and/or media supply spindle of FIGS. 1B and 1C), illustrating a guide member of the media guide in a collapsed position for unobstructed loading/unloading of the media roll from the media spindle, according to various embodiments.
Figure 3:
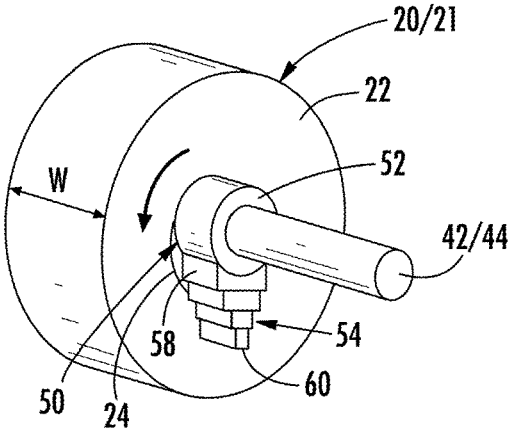
FIG. 3 is a similar view to FIG. 2C, illustrating the guide member of the media guide in an extended position for guiding the media roll during operation of the printer, according to various embodiments.
Figure 3A:
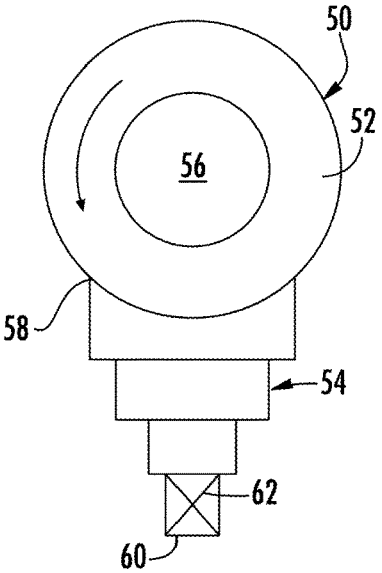
FIGS. 3A and 3B are front views of the media guide in isolation, illustrating extension (FIG. 3A) and retraction (FIG. 3B) of the guide member thereof by rotation of the main body portion of the guide member, according to various embodiments.
Figure 3B:
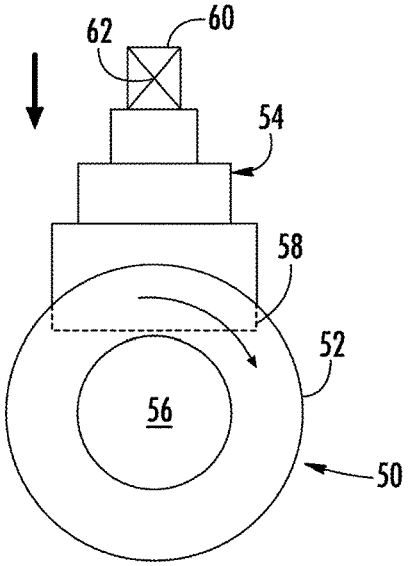

Referring now specifically to FIGS. 2 through 3B, according to various embodiments, the media guide 50 configured for use in a printer (such as the printer 30 depicted in FIGS. 1A through 1C) is depicted. The media guide 50 may be used on at least one of the media supply spindle 42 and the media rewind spindle 44 (as noted previously, referred to collectively herein, unless otherwise specified as a "media spindle"). While FIG. 1B depicts the media guide 50 disposed on the media rewind spindle 44 for guiding the media rewind roll 21 and FIG. 1C depicts the media guide 50 disposed on the media supply spindle 42 for guiding the media supply roll 20, it is to be understood that the media guide may be disposed on one or both ("at least one") of the media supply spindle and the media rewind spindle. The media guide 50 may be a printer accessory and thus removable from the printer (more particularly, from the media spindle 42/44 of the printer). The media guide 50 may alternatively be an integral part of the media spindle 42/44.

Still referring to FIGS. 2 through 3B, according to various embodiments, the media guide 50 generally comprises a main body portion 52 and a collapsible/extendible guide member 54 connected thereto. The "connected" guide member 54 may be integral with the main body portion 52 (i.e., one-piece) or may be assembled together with the main body portion by mechanical means or the like. The main body portion 52 of the media guide 50 has an internal bore 56 configured to be disposed around the media spindle 42/44 as depicted in FIGS. 2C and 3. The media spindle 42/44 extends through the internal bore 56. The position of the media guide 50 along the length of the media spindle 42/44 is adjustable by sliding the media guide 50 along the length of the media spindle. The media guide 50 may be locked onto the media spindle 42/44 in an operating position (a selected position along the length of the media spindle) where the media guide 50 remains adjacent to and outboard of the media roll. Thus, the selected position depends upon a width (w) (FIGS. 2C and 3) of the media roll. Locking means as known in the art may be used to lock the media guide 50 into the operating position on the media spindle 42/44.

The main body portion 52 may have any shape. The main body portion 52 of the exemplary media guide depicted in FIGS. 2 through 3B has a generally cylindrical shape. The main body portion 52 is dimensioned such that, when the guide member 54 of the media guide 50 is in a collapsed position as hereinafter described and depicted in FIGS. 2 through 2C, the outer diameter of the main body portion 52 is less than the inner diameter of the media core 24, enabling use of the media guide 50 in a printer having limited space within the body 32 thereof and enabling unobstructed loading/unloading of the media roll from the media spindle.

Now referring specifically to FIGS. 3 through 3B, according to various embodiments, the guide member 54 has a first end 58 fixedly coupled to the main body portion 52 and a second free end 60. The second free end 60 may include a weight 62 for purposes as herein described. The guide member 54 has a longitudinal axis that is substantially perpendicular with a longitudinal axis of the internal bore 56. The guide member may itself have any profile. The guide member 54 may be a telescoping guide member.

According to various embodiments and as noted previously, the guide member 54 is configured to be collapsed (FIG. 3B) and to be extended (FIG. 3A) (i.e., the guide member is collapsible (i.e., retractable and extendible). The guide member 54 is configured to be collapsed toward the main body portion 52 to a collapsed position as depicted in FIGS. 2A through 2C and to be extended outwardly from the main body portion 52 to an extended position as depicted in FIGS. 3 and 3A. In the collapsed position, the guide member 54 is retracted into a recess 64 (FIGS. 2A and 2B) in the main body portion 52.

In accordance with various embodiments, FIG. 2C depicts the media guide 50 on the media spindle 42/44 with the guide member 54 in the collapsed position (FIGS. 2A through 2C). As noted previously, the media roll 20/21 may be easily loaded and unloaded onto and from the media spindle 42/44 (e.g., the media supply roll 20 may be unloaded when depleted, in which case, only the media core 24 of the media supply roll 20 may be unloaded). Therefore, the media guide 50 with the guide member 54 in the collapsed position as shown in FIGS. 2A through 2C enables unobstructed loading and unloading of the media roll 20/21 from the media spindle 42/44.

According to various embodiments, the guide member may be extended to the extended position (FIG. 3) by counterclockwise rotation of the main body portion 52 to drop the second free end 60 to a downward position (FIG. 3A) and the guide member may be collapsed/retracted by clockwise 180 degrees rotation of the main body portion 52 to move the guide member 54 to an upright position for free drop down toward the main body portion (FIG. 3B). The guide member 54 may collapse into the recess 64 (FIGS. 2A and 2B) of the main body portion by gravity (free drop down). The guide member 54 may additionally or alternatively be extended and/or retracted by mechanical means. In various embodiments, the user can extend and collapse the guide member regardless of the orientation of the media guide (e.g. the guide member may remain extended by use of a spring, friction, etc. The guide member 54 may be collapsed by the user when the printer is not operating, in order to load or unload the media roll 20/21 from the media spindle 42/44. While counterclockwise rotation to extend and clockwise rotation to retract has been described, it is to be understood that the guide member may be retracted by counterclockwise rotation and extended by clockwise rotation.

Referring again to FIGS. 3 and 3A, according to various embodiments, the media guide 50 with the guide member 54 in the extended position is configured to guide the media roll 20/21 during printer operation. The media guide 50 (more particularly, the guide member 54 thereof) disposed around the media supply spindle 42 guides the media supply roll 20 as the print media 22 unwinds from the media supply roll 20 during printer operation, travels along the media path A (FIG. 1A), and rewinds onto the media rewind roll 21. The media guide 50 disposed around the media rewind spindle 44 may guide the media rewind roll 21 as the print media 22 rewinds onto the media rewind roll.

Still referring to FIG. 3, according to various embodiments, the guide member 54 in the extended position is elongated such that when the media guide 50 is disposed on the media spindle 42/44 with the media roll 20/21, the guide member 54 extends adjacent and along an outboard side of the media roll 20/21, providing an enlarged surface area for better guiding performance relative to conventional media guides that may reach the media core only. The guide member 54 in the extended position has a length according to design requirements and the media roll being used. The length of the guide member 54 in the extended position (the elongated guide member) may be such as to extend substantially to the outer diameter of a full media roll, and even just beyond the outer diameter of a full media roll. In various embodiments, the elongated guide member may be shorter so as to not extend substantially to the outer diameter of a full media roll.

Figure 4:
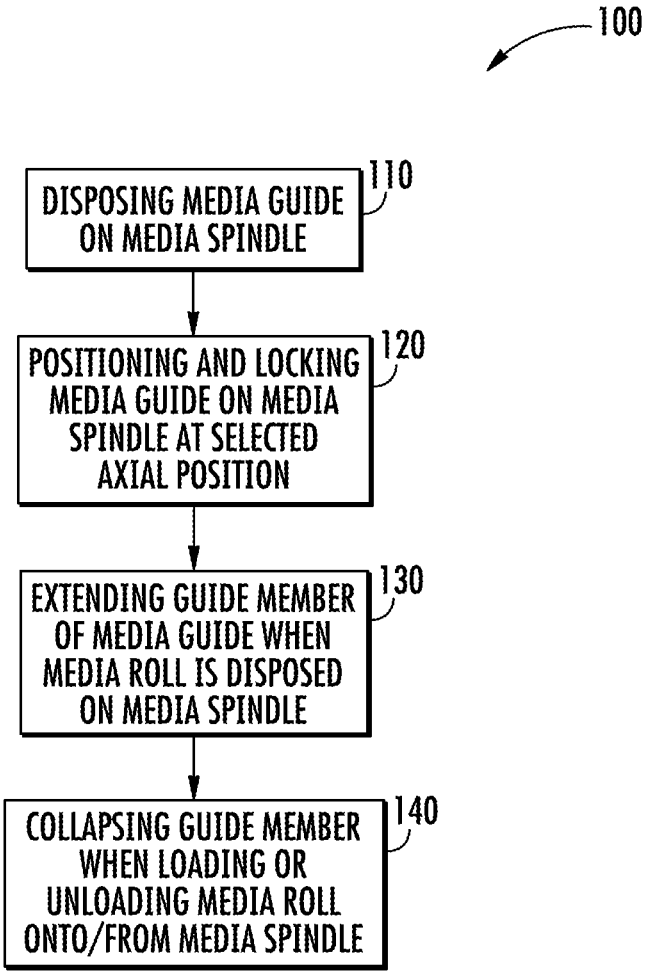
FIG. 4 is a flow diagram of a method for using a media guide in a printer having a media spindle, according to various embodiments.

Referring now to FIG. 4, according to various embodiments, a method 100 for using the media guide in a printer (such as printer 30 depicted in FIGS. 1A through 1C) is illustrated. The method 100 for using a media guide in a printer comprises disposing the media guide on the media spindle such that the media spindle extends through the internal bore of the main body portion of the media guide (step 110).

Still referring to FIG. 4, according to various embodiments, the method 100 for using the media guide in a printer comprises positioning and locking the media guide at a selected position along a length of the media spindle (step 120). Positioning and locking the media guide at a selected position comprises positioning and locking the media guide at the selected position that is adjacent to an outboard side of the media roll when disposed on the media spindle.

Still referring to FIG. 4, and again to FIG. 3A, according to various embodiments, the method 100 for using the media guide in the printer comprises extending the guide member to an extended position when the media roll is disposed on the media spindle (step 130). As noted previously, extending the guide member comprises one of rotating the main body portion of the media guide counterclockwise or clockwise until the guide member may freely drop down as a result of gravity as shown in FIG. 3A or by activating a mechanical mechanism, according to various embodiments. As noted previously, the free second end 60 of the guide member 54 may include the weight 62 to assist with the free drop down.

Still referring to FIG. 4, and again to FIG. 3B, according to various embodiments, the method 100 for using the media guide in the printer comprises the method further comprises collapsing the guide member to a collapsed position when the media roll is configured to be one of loaded onto or unloaded from the media spindle (step 140). As noted previously, retracting the (elongated) guide member comprises rotating the main body portion 52 of the media guide clockwise or counterclockwise (the opposite direction of rotation to extend the guide member) the about 180 degrees from when the guide member is in the extended position. FIG. 3B depicts clockwise rotation of the main body portion 52 to collapse the guide member 54 toward the main body portion 52. The guide member 54 may collapse into the recess 64 (FIGS. 2A and 2B) of the main body portion 52 by gravity (free drop down). While step 140 is depicted in FIG. 4 as being performed after step 130, it is to be understood that step 140 may be performed prior to step 130 if loading the media roll onto the media spindle.

The guide member 54 may be collapsed by the user when the printer is not operating, in order to load or unload the media roll from the media spindle. The guide member is extended to the extended position by counterclockwise rotation of the main body portion to drop the second free end to a downward position and the guide member is retracted by clockwise rotation of the main body portion to move the guide member to an upright position for free drop down toward the main body portion. As noted previously, while counterclockwise rotation to extend and clockwise rotation to retract has been described, it is to be understood that the guide member may be retracted by counterclockwise rotation and extended by clockwise rotation. The rotation direction to extend is opposite the rotation direction to retract.

From the foregoing, it is to be appreciated that a media guide according to various embodiments permits unobstructed loading and unloading of a media roll (a media supply roll and/or a media rewind roll), provides good guiding performance, and may be used in printers having limited space.

To supplement the present disclosure, this application incorporates entirely by reference the following commonly assigned patents, patent application publications, and patent applications:

U.S. Pat. No. 6,832,725; U.S. Pat. No. 7,128,266; U.S. Pat. No. 7,159,783; U.S. Pat. No. 7,413,127; U.S. Pat. No. 7,726,575; U.S. Pat. No. 8,294,969; U.S. Pat. No. 8,317,105; U.S. Pat. No. 8,322,622; U.S. Pat. No. 8,366,005; U.S. Pat. No. 8,371,507; U.S. Pat. No. 8,376,233; U.S. Pat. No. 8,381,979; U.S. Pat. No. 8,390,909; U.S. Pat. No. 8,408,464; U.S. Pat. No. 8,408,468; U.S. Pat. No. 8,408,469; U.S. Pat. No. 8,424,768; U.S. Pat. No. 8,448,863; U.S. Pat. No. 8,457,013; U.S. Pat. No. 8,459,557; U.S. Pat. No. 8,469,272; U.S. Pat. No. 8,474,712; U.S. Pat. No. 8,479,992; U.S. Pat. No. 8,490,877; U.S. Pat. No. 8,517,271; U.S. Pat. No. 8,523,076; U.S. Pat. No. 8,528,818; U.S. Pat. No. 8,544,737; U.S. Pat. No. 8,548,242; U.S. Pat. No. 8,548,420; U.S. Pat. No. 8,550,335; U.S. Pat. No. 8,550,354; U.S. Pat. No. 8,550,357; U.S. Pat. No. 8,556,174; U.S. Pat. No. 8,556,176; U.S. Pat. No. 8,556,177; U.S. Pat. No. 8,559,767; U.S. Pat. No. 8,599,957; U.S. Pat. No. 8,561,895; U.S. Pat. No. 8,561,903; U.S. Pat. No. 8,561,905; U.S. Pat. No. 8,565,107; U.S. Pat. No. 8,571,307; U.S. Pat. No. 8,579,200; U.S. Pat. No. 8,583,924; U.S. Pat. No. 8,584,945; U.S. Pat. No. 8,587,595; U.S. Pat. No. 8,587,697; U.S. Pat. No. 8,588,869; U.S. Pat. No. 8,590,789; U.S. Pat. No. 8,596,539; U.S. Pat. No. 8,596,542; U.S. Pat. No. 8,596,543; U.S. Pat. No. 8,599,271; U.S. Pat. No. 8,599,957; U.S. Pat. No. 8,600,158; U.S. Pat. No. 8,600,167; U.S. Pat. No. 8,602,309; U.S. Pat. No. 8,608,053; U.S. Pat. No. 8,608,071; U.S. Pat. No. 8,611,309; U.S. Pat. No. 8,615,487; U.S. Pat. No. 8,616,454; U.S. Pat. No. 8,621,123; U.S. Pat. No. 8,622,303; U.S. Pat. No. 8,628,013; U.S. Pat. No. 8,628,015; U.S. Pat. No. 8,628,016; U.S. Pat. No. 8,629,926; U.S. Pat. No. 8,630,491; U.S. Pat. No. 8,635,309; U.S. Pat. No. 8,636,200; U.S. Pat. No. 8,636,212; U.S. Pat. No. 8,636,215; U.S. Pat. No. 8,636,224; U.S. Pat. No. 8,638,806; U.S. Pat. No. 8,640,958; U.S. Pat. No. 8,640,960; U.S. Pat. No. 8,643,717; U.S. Pat. No. 8,646,692; U.S. Pat. No. 8,646,694; U.S. Pat. No. 8,657,200; U.S. Pat. No. 8,659,397; U.S. Pat. No. 8,668,149; U.S. Pat. No. 8,678,285; U.S. Pat. No. 8,678,286; U.S. Pat. No. 8,682,077; U.S. Pat. No. 8,687,282; U.S. Pat. No. 8,692,927; U.S. Pat. No. 8,695,880; U.S. Pat. No. 8,698,949; U.S. Pat. No. 8,717,494; U.S. Pat. No. 8,717,494; U.S. Pat. No. 8,720,783; U.S. Pat. No. 8,723,804; U.S. Pat. No. 8,723,904; U.S. Pat. No. 8,727,223; U.S. Pat. No. D702,237; U.S. Pat. No. 8,740,082; U.S. Pat. No. 8,740,085; U.S. Pat. No. 8,746,563; U.S. Pat. No. 8,750,445; U.S. Pat. No. 8,752,766; U.S. Pat. No. 8,756,059; U.S. Pat. No. 8,757,495; U.S. Pat. No. 8,760,563; U.S. Pat. No. 8,763,909; U.S. Pat. No. 8,777,108; U.S. Pat. No. 8,777,109; U.S. Pat. No. 8,779,898; U.S. Pat. No. 8,781,520; U.S. Pat. No. 8,783,573; U.S. Pat. No. 8,789,757; U.S. Pat. No. 8,789,758; U.S. Pat. No. 8,789,759; U.S. Pat. No. 8,794,520; U.S. Pat. No. 8,794,522; U.S. Pat. No. 8,794,525; U.S. Pat. No. 8,794,526; U.S. Pat. No. 8,798,367; U.S. Pat. No. 8,807,431; U.S. Pat. No. 8,807,432; U.S. Pat. No. 8,820,630; U.S. Pat. No. 8,822,848; U.S. Pat. No. 8,824,692; U.S. Pat. No. 8,824,696; U.S. Pat. No. 8,842,849; U.S. Pat. No. 8,844,822; U.S. Pat. No. 8,844,823; U.S. Pat. No. 8,849,019; U.S. Pat. No. 8,851,383; U.S. Pat. No. 8,854,633; U.S. Pat. No. 8,866,963; U.S. Pat. No. 8,868,421; U.S. Pat. No. 8,868,519; U.S. Pat. No. 8,868,802; U.S. Pat. No. 8,868,803; U.S. Pat. No. 8,870,074; U.S. Pat. No. 8,879,639; U.S. Pat. No. 8,880,426; U.S. Pat. No. 8,881,983; U.S. Pat. No. 8,881,987; U.S. Pat. No. 8,903,172; U.S. Pat. No. 8,908,995; U.S. Pat. No. 8,910,870; U.S. Pat. No. 8,910,875; U.S. Pat. No. 8,914,290; U.S. Pat. No. 8,914,788; U.S. Pat. No. 8,915,439; U.S. Pat. No. 8,915,444; U.S. Pat. No. 8,916,789; U.S. Pat. No. 8,918,250; U.S. Pat. No. 8,918,564; U.S. Pat. No. 8,925,818; U.S. Pat. No. 8,939,374; U.S. Pat. No. 8,942,480; U.S. Pat. No. 8,944,313; U.S. Pat. No. 8,944,327; U.S. Pat. No. 8,944,332; U.S. Pat. No. 8,950,678; U.S. Pat. No. 8,967,468; U.S. Pat. No. 8,971,346; U.S. Pat. No. 8,976,030; U.S. Pat. No. 8,976,368; U.S. Pat. No. 8,978,981; U.S. Pat. No. 8,978,983; U.S. Pat. No. 8,978,984; U.S. Pat. No. 8,985,456;

U.S. Pat. No. 8,985,457; U.S. Pat. No. 8,985,459;
U.S. Pat. No. 8,985,461; U.S. Pat. No. 8,988,578;
U.S. Pat. No. 8,988,590; U.S. Pat. No. 8,991,704;
U.S. Pat. No. 8,996,194; U.S. Pat. No. 8,996,384;
U.S. Pat. No. 9,002,641; U.S. Pat. No. 9,007,368;
U.S. Pat. No. 9,010,641; U.S. Pat. No. 9,015,513;
U.S. Pat. No. 9,016,576; U.S. Pat. No. 9,022,288;
U.S. Pat. No. 9,030,964; U.S. Pat. No. 9,033,240;
U.S. Pat. No. 9,033,242; U.S. Pat. No. 9,036,054;
U.S. Pat. No. 9,037,344; U.S. Pat. No. 9,038,911;
U.S. Pat. No. 9,038,915; U.S. Pat. No. 9,047,098;
U.S. Pat. No. 9,047,359; U.S. Pat. No. 9,047,420;
U.S. Pat. No. 9,047,525; U.S. Pat. No. 9,047,531;
U.S. Pat. No. 9,053,055; U.S. Pat. No. 9,053,378;
U.S. Pat. No. 9,053,380; U.S. Pat. No. 9,058,526;
U.S. Pat. No. 9,064,165; U.S. Pat. No. 9,064,167;
U.S. Pat. No. 9,064,168; U.S. Pat. No. 9,064,254;
U.S. Pat. No. 9,066,032; U.S. Pat. No. 9,070,032;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D733,112;
U.S. Design Pat. No. D734,339;
International Publication No. 2013/163789;
International Publication No. 2013/173985;
International Publication No. 2014/019130;
International Publication No. 2014/110495;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0287258;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0313325;
U.S. Patent Application Publication No. 2013/0342717;
U.S. Patent Application Publication No. 2014/0001267;
U.S. Patent Application Publication No. 2014/0008439;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0042814;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0078341;
U.S. Patent Application Publication No. 2014/0078345;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0104451;
U.S. Patent Application Publication No. 2014/0106594;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0114530;
U.S. Patent Application Publication No. 2014/0124577;
U.S. Patent Application Publication No. 2014/0124579;
U.S. Patent Application Publication No. 2014/0125842;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131438;
U.S. Patent Application Publication No. 2014/0131441;
U.S. Patent Application Publication No. 2014/0131443;
U.S. Patent Application Publication No. 2014/0131444;
U.S. Patent Application Publication No. 2014/0131445;
U.S. Patent Application Publication No. 2014/0131448;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0151453;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166755;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0175172;
U.S. Patent Application Publication No. 2014/0191644;
U.S. Patent Application Publication No. 2014/0191913;
U.S. Patent Application Publication No. 2014/0197238;
U.S. Patent Application Publication No. 2014/0197239;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0217180;
U.S. Patent Application Publication No. 2014/0231500;
U.S. Patent Application Publication No. 2014/0232930;
U.S. Patent Application Publication No. 2014/0247315;
U.S. Patent Application Publication No. 2014/0263493;
U.S. Patent Application Publication No. 2014/0263645;

U.S. Patent Application Publication No. 2014/0267609;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0278391;
U.S. Patent Application Publication No. 2014/0282210;
U.S. Patent Application Publication No. 2014/0284384;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0312121;
U.S. Patent Application Publication No. 2014/0319220;
U.S. Patent Application Publication No. 2014/0319221;
U.S. Patent Application Publication No. 2014/0326787;
U.S. Patent Application Publication No. 2014/0332590;
U.S. Patent Application Publication No. 2014/0344943;
U.S. Patent Application Publication No. 2014/0346233;
U.S. Patent Application Publication No. 2014/0351317;
U.S. Patent Application Publication No. 2014/0353373;
U.S. Patent Application Publication No. 2014/0361073;
U.S. Patent Application Publication No. 2014/0361082;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0003673;
U.S. Patent Application Publication No. 2015/0009338;
U.S. Patent Application Publication No. 2015/0009610;
U.S. Patent Application Publication No. 2015/0014416;
U.S. Patent Application Publication No. 2015/0021397;
U.S. Patent Application Publication No. 2015/0028102;
U.S. Patent Application Publication No. 2015/0028103;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0048168;
U.S. Patent Application Publication No. 2015/0049347;
U.S. Patent Application Publication No. 2015/0051992;
U.S. Patent Application Publication No. 2015/0053766;
U.S. Patent Application Publication No. 2015/0053768;
U.S. Patent Application Publication No. 2015/0053769;
U.S. Patent Application Publication No. 2015/0060544;
U.S. Patent Application Publication No. 2015/0062366;
U.S. Patent Application Publication No. 2015/0063215;
U.S. Patent Application Publication No. 2015/0063676;
U.S. Patent Application Publication No. 2015/0069130;
U.S. Patent Application Publication No. 2015/0071819;
U.S. Patent Application Publication No. 2015/0083800;
U.S. Patent Application Publication No. 2015/0086114;
U.S. Patent Application Publication No. 2015/0088522;
U.S. Patent Application Publication No. 2015/0096872;
U.S. Patent Application Publication No. 2015/0099557;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0129659;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0136854;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0144701;
U.S. Patent Application Publication No. 2015/0149946;
U.S. Patent Application Publication No. 2015/0161429;
U.S. Patent Application Publication No. 2015/0169925;
U.S. Patent Application Publication No. 2015/0169929;
U.S. Patent Application Publication No. 2015/0178523;
U.S. Patent Application Publication No. 2015/0178534;
U.S. Patent Application Publication No. 2015/0178535;
U.S. Patent Application Publication No. 2015/0178536;
U.S. Patent Application Publication No. 2015/0178537;
U.S. Patent Application Publication No. 2015/0181093;
U.S. Patent Application Publication No. 2015/0181109;

U.S. patent application Ser. No. 13/367,978 for a Laser Scanning Module Employing an Elastomeric U-Hinge Based Laser Scanning Assembly, filed Feb. 7, 2012 (Feng et al.);

U.S. patent application Ser. No. 29/458,405 for an Electronic Device, filed Jun. 19, 2013 (Fitch et al.);

U.S. patent application Ser. No. 29/459,620 for an Electronic Device Enclosure, filed Jul. 2, 2013 (London et al.);

U.S. patent application Ser. No. 29/468,118 for an Electronic Device Case, filed Sep. 26, 2013 (Oberpriller et al.);

U.S. patent application Ser. No. 14/150,393 for Indicia-reader Having Unitary Construction Scanner, filed Jan. 8, 2014 (Colavito et al.);

U.S. patent application Ser. No. 14/200,405 for Indicia Reader for Size-Limited Applications filed Mar. 7, 2014 (Feng et al.);

U.S. patent application Ser. No. 14/231,898 for Hand-Mounted Indicia-Reading Device with Finger Motion Triggering filed Apr. 1, 2014 (Van Horn et al.);

U.S. patent application Ser. No. 29/486,759 for an Imaging Terminal, filed Apr. 2, 2014 (Oberpriller et al.);

U.S. patent application Ser. No. 14/257,364 for Docking System and Method Using Near Field Communication filed Apr. 21, 2014 (Showering);

U.S. patent application Ser. No. 14/264,173 for Autofocus Lens System for Indicia Readers filed Apr. 29, 2014 (Ackley et al.);

U.S. patent application Ser. No. 14/277,337 for MULTI-PURPOSE OPTICAL READER, filed May 14, 2014 (Jovanovski et al.);

U.S. patent application Ser. No. 14/283,282 for TERMINAL HAVING ILLUMINATION AND FOCUS CONTROL filed May 21, 2014 (Liu et al.);

U.S. patent application Ser. No. 14/327,827 for a MOBILE-PHONE ADAPTER FOR ELECTRONIC TRANSACTIONS, filed Jul. 10, 2014 (Hejl);

U.S. patent application Ser. No. 14/334,934 for a SYSTEM AND METHOD FOR INDICIA VERIFICATION, filed Jul. 18, 2014 (Hejl);

U.S. patent application Ser. No. 14/339,708 for LASER SCANNING CODE SYMBOL READING SYSTEM, filed Jul. 24, 2014 (Xian et al.);

U.S. patent application Ser. No. 14/340,627 for an AXIALLY REINFORCED FLEXIBLE SCAN ELEMENT, filed Jul. 25, 2014 (Rueblinger et al.);

U.S. patent application Ser. No. 14/446,391 for MULTI-FUNCTION POINT OF SALE APPARATUS WITH OPTICAL SIGNATURE CAPTURE filed Jul. 30, 2014 (Good et al.);

U.S. patent application Ser. No. 14/452,697 for INTERACTIVE INDICIA READER, filed Aug. 6, 2014 (Todeschini);

U.S. patent application Ser. No. 14/453,019 for DIMENSIONING SYSTEM WITH GUIDED ALIGNMENT, filed Aug. 6, 2014 (Li et al.);

U.S. patent application Ser. No. 14/462,801 for MOBILE COMPUTING DEVICE WITH DATA COGNITION SOFTWARE, filed on Aug. 19, 2014 (Todeschini et al.);

U.S. patent application Ser. No. 14/483,056 for VARIABLE DEPTH OF FIELD BARCODE SCANNER filed Sep. 10, 2014 (McCloskey et al.);

U.S. patent application Ser. No. 14/513,808 for IDENTIFYING INVENTORY ITEMS IN A STORAGE FACILITY filed Oct. 14, 2014 (Singel et al.);

U.S. patent application Ser. No. 14/519,195 for HANDHELD DIMENSIONING SYSTEM WITH FEEDBACK filed Oct. 21, 2014 (Laffargue et al.);

U.S. patent application Ser. No. 14/519,179 for DIMENSIONING SYSTEM WITH MULTIPATH INTERFERENCE MITIGATION filed Oct. 21, 2014 (Thuries et al.);

U.S. patent application Ser. No. 14/519,211 for SYSTEM AND METHOD FOR DIMENSIONING filed Oct. 21, 2014 (Ackley et al.);

U.S. patent application Ser. No. 14/519,233 for HANDHELD DIMENSIONER WITH DATA-QUALITY INDICATION filed Oct. 21, 2014 (Laffargue et al.);

U.S. patent application Ser. No. 14/519,249 for HANDHELD DIMENSIONING SYSTEM WITH MEASUREMENT-CONFORMANCE FEEDBACK filed Oct. 21, 2014 (Ackley et al.);

U.S. patent application Ser. No. 14/527,191 for METHOD AND SYSTEM FOR RECOGNIZING SPEECH USING WILDCARDS IN AN EXPECTED RESPONSE filed Oct. 29, 2014 (Braho et al.);

U.S. patent application Ser. No. 14/529,563 for ADAPTABLE INTERFACE FOR A MOBILE COMPUTING DEVICE filed Oct. 31, 2014 (Schoon et al.);

U.S. patent application Ser. No. 14/529,857 for BARCODE READER WITH SECURITY FEATURES filed Oct. 31, 2014 (Todeschini et al.);

U.S. patent application Ser. No. 14/398,542 for PORTABLE ELECTRONIC DEVICES HAVING A SEPARATE LOCATION TRIGGER UNIT FOR USE IN CONTROLLING AN APPLICATION UNIT filed Nov. 3, 2014 (Bian et al.);

U.S. patent application Ser. No. 14/531,154 for DIRECTING AN INSPECTOR THROUGH AN INSPECTION filed Nov. 3, 2014 (Miller et al.);

U.S. patent application Ser. No. 14/533,319 for BARCODE SCANNING SYSTEM USING WEARABLE DEVICE WITH EMBEDDED CAMERA filed Nov. 5, 2014 (Todeschini);

U.S. patent application Ser. No. 14/535,764 for CONCATENATED EXPECTED RESPONSES FOR SPEECH RECOGNITION filed Nov. 7, 2014 (Braho et al.);

U.S. patent application Ser. No. 14/568,305 for AUTO-CONTRAST VIEWFINDER FOR AN INDICIA READER filed Dec. 12, 2014 (Todeschini);

U.S. patent application Ser. No. 14/573,022 for DYNAMIC DIAGNOSTIC INDICATOR GENERATION filed Dec. 17, 2014 (Goldsmith);

U.S. patent application Ser. No. 14/578,627 for SAFETY SYSTEM AND METHOD filed Dec. 22, 2014 (Ackley et al.);

U.S. patent application Ser. No. 14/580,262 for MEDIA GATE FOR THERMAL TRANSFER PRINTERS filed Dec. 23, 2014 (Bowles);

U.S. patent application Ser. No. 14/590,024 for SHELVING AND PACKAGE LOCATING SYSTEMS FOR DELIVERY VEHICLES filed Jan. 6, 2015 (Payne);

U.S. patent application Ser. No. 14/596,757 for SYSTEM AND METHOD FOR DETECTING BARCODE PRINTING ERRORS filed Jan. 14, 2015 (Ackley);

U.S. patent application Ser. No. 14/416,147 for OPTICAL READING APPARATUS HAVING VARIABLE SETTINGS filed Jan. 21, 2015 (Chen et al.);

U.S. patent application Ser. No. 14/614,706 for DEVICE FOR SUPPORTING AN ELECTRONIC TOOL ON A USER'S HAND filed Feb. 5, 2015 (Oberpriller et al.);

U.S. patent application Ser. No. 14/614,796 for CARGO APPORTIONMENT TECHNIQUES filed Feb. 5, 2015 (Morton et al.);

U.S. patent application Ser. No. 29/516,892 for TABLE COMPUTER filed Feb. 6, 2015 (Bidwell et al.);

U.S. patent application Ser. No. 14/619,093 for METHODS FOR TRAINING A SPEECH RECOGNITION SYSTEM filed Feb. 11, 2015 (Pecorari);

U.S. patent application Ser. No. 14/628,708 for DEVICE, SYSTEM, AND METHOD FOR DETERMINING THE STATUS OF CHECKOUT LANES filed Feb. 23, 2015 (Todeschini);

U.S. patent application Ser. No. 14/630,841 for TERMINAL INCLUDING IMAGING ASSEMBLY filed Feb. 25, 2015 (Gomez et al.);

U.S. patent application Ser. No. 14/635,346 for SYSTEM AND METHOD FOR RELIABLE STORE-AND-FORWARD DATA HANDLING BY ENCODED INFORMATION READING TERMINALS filed Mar. 2, 2015 (Sevier);

U.S. patent application Ser. No. 29/519,017 for SCANNER filed Mar. 2, 2015 (Zhou et al.);

U.S. patent application Ser. No. 14/405,278 for DESIGN PATTERN FOR SECURE STORE filed Mar. 9, 2015 (Zhu et al.);

U.S. patent application Ser. No. 14/660,970 for DECODABLE INDICIA READING TERMINAL WITH COMBINED ILLUMINATION filed Mar. 18, 2015 (Kearney et al.);

U.S. patent application Ser. No. 14/661,013 for REPROGRAMMING SYSTEM AND METHOD FOR DEVICES INCLUDING PROGRAMMING SYMBOL filed Mar. 18, 2015 (Soule et al.);

U.S. patent application Ser. No. 14/662,922 for MULTIFUNCTION POINT OF SALE SYSTEM filed Mar. 19, 2015 (Van Horn et al.);

U.S. patent application Ser. No. 14/663,638 for VEHICLE MOUNT COMPUTER WITH CONFIGURABLE IGNITION SWITCH BEHAVIOR filed Mar. 20, 2015 (Davis et al.);

U.S. patent application Ser. No. 14/664,063 for METHOD AND APPLICATION FOR SCANNING A BARCODE WITH A SMART DEVICE WHILE CONTINUOUSLY RUNNING AND DISPLAYING AN APPLICATION ON THE SMART DEVICE DISPLAY filed Mar. 20, 2015 (Todeschini);

U.S. patent application Ser. No. 14/669,280 for TRANSFORMING COMPONENTS OF A WEB PAGE TO VOICE PROMPTS filed Mar. 26, 2015 (Funyak et al.);

U.S. patent application Ser. No. 14/674,329 for AIMER FOR BARCODE SCANNING filed Mar. 31, 2015 (Bidwell);

U.S. patent application Ser. No. 14/676,109 for INDICIA READER filed Apr. 1, 2015 (Huck);

U.S. patent application Ser. No. 14/676,327 for DEVICE MANAGEMENT PROXY FOR SECURE DEVICES filed Apr. 1, 2015 (Yeakley et al.);

U.S. patent application Ser. No. 14/676,898 for NAVIGATION SYSTEM CONFIGURED TO INTEGRATE MOTION SENSING DEVICE INPUTS filed Apr. 2, 2015 (Showering);

U.S. patent application Ser. No. 14/679,275 for DIMENSIONING SYSTEM CALIBRATION SYSTEMS AND METHODS filed Apr. 6, 2015 (Laffargue et al.);

U.S. patent application Ser. No. 29/523,098 for HANDLE FOR A TABLET COMPUTER filed Apr. 7, 2015 (Bidwell et al.);

U.S. patent application Ser. No. 14/682,615 for SYSTEM AND METHOD FOR POWER MANAGEMENT OF MOBILE DEVICES filed Apr. 9, 2015 (Murawski et al.);

U.S. patent application Ser. No. 14/686,822 for MULTIPLE PLATFORM SUPPORT SYSTEM AND METHOD filed Apr. 15, 2015 (Qu et al.);

U.S. patent application Ser. No. 14/687,289 for SYSTEM FOR COMMUNICATION VIA A PERIPHERAL HUB filed Apr. 15, 2015 (Kohtz et al.);

U.S. patent application Ser. No. 29/524,186 for SCANNER filed Apr. 17, 2015 (Zhou et al.);

U.S. patent application Ser. No. 14/695,364 for MEDICATION MANAGEMENT SYSTEM filed Apr. 24, 2015 (Sewell et al.);

U.S. patent application Ser. No. 14/695,923 for SECURE UNATTENDED NETWORK AUTHENTICATION filed Apr. 24, 2015 (Kubler et al.);

U.S. patent application Ser. No. 29/525,068 for TABLET COMPUTER WITH REMOVABLE SCANNING DEVICE filed Apr. 27, 2015 (Schulte et al.);

U.S. patent application Ser. No. 14/699,436 for SYMBOL READING SYSTEM HAVING PREDICTIVE DIAGNOSTICS filed Apr. 29, 2015 (Nahill et al.);

U.S. patent application Ser. No. 14/702,110 for SYSTEM AND METHOD FOR REGULATING BARCODE DATA INJECTION INTO A RUNNING APPLICATION ON A SMART DEVICE filed May 1, 2015 (Todeschini et al.);

U.S. patent application Ser. No. 14/702,979 for TRACKING BATTERY CONDITIONS filed May 4, 2015 (Young et al.);

U.S. patent application Ser. No. 14/704,050 for INTERMEDIATE LINEAR POSITIONING filed May 5, 2015 (Charpentier et al.);

U.S. patent application Ser. No. 14/705,012 for HANDS-FREE HUMAN MACHINE INTERFACE RESPONSIVE TO A DRIVER OF A VEHICLE filed May 6, 2015 (Fitch et al.);

U.S. patent application Ser. No. 14/705,407 for METHOD AND SYSTEM TO PROTECT SOFTWARE-BASED NETWORK-CONNECTED DEVICES FROM ADVANCED PERSISTENT THREAT filed May 6, 2015 (Hussey et al.);

U.S. patent application Ser. No. 14/707,037 for SYSTEM AND METHOD FOR DISPLAY OF INFORMATION USING A VEHICLE-MOUNT COMPUTER filed May 8, 2015 (Chamberlin);

U.S. patent application Ser. No. 14/707,123 for APPLICATION INDEPENDENT DEX/UCS INTERFACE filed May 8, 2015 (Pape);

U.S. patent application Ser. No. 14/707,492 for METHOD AND APPARATUS FOR READING OPTICAL INDICIA USING A PLURALITY OF DATA SOURCES filed May 8, 2015 (Smith et al.);

U.S. patent application Ser. No. 14/710,666 for PRE-PAID USAGE SYSTEM FOR ENCODED INFORMATION READING TERMINALS filed May 13, 2015 (Smith);

U.S. patent application Ser. No. 29/526,918 for CHARGING BASE filed May 14, 2015 (Fitch et al.);

U.S. patent application Ser. No. 14/715,672 for AUGUMENTED REALITY ENABLED HAZARD DISPLAY filed May 19, 2015 (Venkatesha et al.);

U.S. patent application Ser. No. 14/715,916 for EVALUATING IMAGE VALUES filed May 19, 2015 (Ackley);

U.S. patent application Ser. No. 14/722,608 for INTERACTIVE USER INTERFACE FOR CAPTURING A DOCUMENT IN AN IMAGE SIGNAL filed May 27, 2015 (Showering et al.);

U.S. patent application Ser. No. 29/528,165 for IN-COUNTER BARCODE SCANNER filed May 27, 2015 (Oberpriller et al.);

U.S. patent application Ser. No. 14/724,134 for ELECTRONIC DEVICE WITH WIRELESS PATH SELECTION CAPABILITY filed May 28, 2015 (Wang et al.);

U.S. patent application Ser. No. 14/724,849 for METHOD OF PROGRAMMING THE DEFAULT CABLE INTERFACE SOFTWARE IN AN INDICIA READING DEVICE filed May 29, 2015 (Barten);

U.S. patent application Ser. No. 14/724,908 for IMAGING APPARATUS HAVING IMAGING ASSEMBLY filed May 29, 2015 (Barber et al.);

U.S. patent application Ser. No. 14/725,352 for APPARATUS AND METHODS FOR MONITORING ONE OR MORE PORTABLE DATA TERMINALS (Caballero et al.);

U.S. patent application Ser. No. 29/528,590 for ELECTRONIC DEVICE filed May 29, 2015 (Fitch et al.);

U.S. patent application Ser. No. 29/528,890 for MOBILE COMPUTER HOUSING filed Jun. 2, 2015 (Fitch et al.);

U.S. patent application Ser. No. 14/728,397 for DEVICE MANAGEMENT USING VIRTUAL INTERFACES CROSS-REFERENCE TO RELATED APPLICATIONS filed Jun. 2, 2015 (Caballero);

U.S. patent application Ser. No. 14/732,870 for DATA COLLECTION MODULE AND SYSTEM filed Jun. 8, 2015 (Powilleit);

U.S. patent application Ser. No. 29/529,441 for INDICIA READING DEVICE filed Jun. 8, 2015 (Zhou et al.);

U.S. patent application Ser. No. 14/735,717 for INDICIA-READING SYSTEMS HAVING AN INTERFACE WITH A USER'S NERVOUS SYSTEM filed Jun. 10, 2015 (Todeschini);

U.S. patent application Ser. No. 14/738,038 for METHOD OF AND SYSTEM FOR DETECTING OBJECT WEIGHING INTERFERENCES filed Jun. 12, 2015 (Amundsen et al.);

U.S. patent application Ser. No. 14/740,320 for TACTILE SWITCH FOR A MOBILE ELECTRONIC DEVICE filed Jun. 16, 2015 (Bandringa);

U.S. patent application Ser. No. 14/740,373 for CALIBRATING A VOLUME DIMENSIONER filed Jun. 16, 2015 (Ackley et al.);

U.S. patent application Ser. No. 14/742,818 for INDICIA READING SYSTEM EMPLOYING DIGITAL GAIN CONTROL filed Jun. 18, 2015 (Xian et al.);

U.S. patent application Ser. No. 14/743,257 for WIRELESS MESH POINT PORTABLE DATA TERMINAL filed Jun. 18, 2015 (Wang et al.);

U.S. patent application Ser. No. 29/530,600 for CYCLONE filed Jun. 18, 2015 (Vargo et al);

U.S. patent application Ser. No. 14/744,633 for IMAGING APPARATUS COMPRISING IMAGE SENSOR ARRAY HAVING SHARED GLOBAL SHUTTER CIRCUITRY filed Jun. 19, 2015 (Wang);

U.S. patent application Ser. No. 14/744,836 for CLOUD-BASED SYSTEM FOR READING OF DECODABLE INDICIA filed Jun. 19, 2015 (Todeschini et al.);

U.S. patent application Ser. No. 14/745,006 for SELECTIVE OUTPUT OF DECODED MESSAGE DATA filed Jun. 19, 2015 (Todeschini et al.);

U.S. patent application Ser. No. 14/747,197 for OPTICAL PATTERN PROJECTOR filed Jun. 23, 2015 (Thuries et al.);

U.S. patent application Ser. No. 14/747,490 for DUAL-PROJECTOR THREE-DIMENSIONAL SCANNER filed Jun. 23, 2015 (Jovanovski et al.); and U.S. patent application Ser. No. 14/748,446 for CORDLESS INDICIA READER WITH A MULTIFUNCTION COIL FOR WIRELESS CHARGING AND EAS DEACTIVATION, filed Jun. 24, 2015 (Xie et al.).

In the specification and/or figures, typical embodiments of the present invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A media guide for use in a printer, the media guide comprising:

a main body portion having an internal bore configured to be disposed around a media spindle; and a guide member connected to the main body portion and configured to telescopically extend outwardly in a direction perpendicular to a longitudinal axis of the internal bore from the main body portion to an extended position and telescopically retract toward the main body portion to a collapsed position.

2. The media guide according to claim 1, wherein the guide member is configured to retract into a recess in the main body portion.

3. The media guide according to claim 1, wherein the guide member has a first end connected to the main body portion and a second free end.

4. The media guide according to claim 3, wherein the guide member is extended to the extended position by rotation of the main body portion in a first direction to drop the second free end to a downward position.

5. The media guide according to claim 4, wherein the guide member is retracted by rotation of the main body portion in an opposite second direction to move the guide member to an upright position for free drop down toward the main body portion.

6. The media guide according to claim 1, wherein the guide member has a longitudinal axis that is substantially perpendicular with a longitudinal axis of the internal bore.

7. The media guide according to claim 1, wherein the guide member is integrally formed as one piece with the main body portion.

8. The media guide according to claim 1, wherein the main body portion is configured to be disposed around the media spindle at a selected position along a length thereof, the selected position dependent upon a width (w) of the media roll.

9. The media guide according to claim 1, wherein an outer diameter of the main body portion is less than an inner diameter of a media core when the guide member is in the collapsed position.

10. A printer comprising:

a media spindle configured for having a media roll disposed thereon; and a media guide comprising:

a main body portion having an internal bore configured to be disposed around the media spindle at a position outboard of the media roll; and a guide member connected to the main body portion and configured to be telescopically extended outwardly in a direction perpendicular to a longitudinal axis of the internal bore from the main body portion to an extended position and to be telescopically retracted toward the main body portion to a collapsed position.

11. The printer according to claim 10, wherein the media spindle comprises at least one of a media supply spindle and a media rewind spindle and the media roll comprises at least one of a media supply roll and a media rewind roll, the media supply spindle configured for having the media supply roll disposed thereon and the media rewind spindle configured for having the media rewind roll disposed thereon.

12. The printer according to claim 10, wherein the guide member is configured to retract into a recess in the main body portion.

13. The printer according to claim 10, wherein the guide member has a first end connected to the main body portion and a second free end.

14. The printer according to claim 13, wherein the guide member is extended to the extended position by rotation of the main body portion in a first direction to drop the second free end to a downward position.

15. The printer according to claim 14, wherein the guide member is retracted by rotation of the main body portion in an opposite second direction to move the guide member to an upright position for free drop down toward the main body portion.

16. The printer according to claim 10, wherein the guide member has a longitudinal axis that is substantially perpendicular with a longitudinal axis of the internal bore.

17. The printer according to claim 10, wherein the main body portion is configured to be disposed around the media spindle at a position along a length thereof, the position dependent upon a width (w) of the media roll.

18. The media guide according to claim 10, wherein an outer diameter of the main body portion is less than an inner diameter of a media core when the guide member is in the collapsed position.

19. A method for using a media guide in a printer, the method comprising:

disposing the media guide on a media spindle such that the media spindle extends through an internal bore of a main body portion of the media guide, the main body portion connected to a guide member of the media guide;

positioning and locking the media guide at a selected position along a length of the media spindle; and wherein when the media roll is disposed on the media spindle, the method further comprises telescopically extending the guide member in a direction perpendicular to a longitudinal axis of the internal bore to an extended position;

wherein when the media roll is configured to be one of loaded onto or unloaded from the media spindle, the method further comprises telescopically collapsing the guide member to a collapsed position.

20. The method according to claim 19, wherein positioning and locking the media guide at a selected position comprises positioning and locking the media guide at the selected position that is adjacent to an outboard side of the media roll when disposed on the media spindle.

21. The method according to claim 19, wherein extending the guide member to the extended position comprises rotating the main body portion to position the guide member downwardly causing the guide member to drop down away from the main body portion by gravity.

22. The method according to claim 19, wherein collapsing the guide member to the collapsed position comprises rotating the main body portion to position the guide member upwardly causing the guide member to collapse toward the main body portion by gravity.

* * * * *